US008348189B2

(12) United States Patent
Kusters

(10) Patent No.: US 8,348,189 B2
(45) Date of Patent: Jan. 8, 2013

(54) DEVICE FOR SHREDDING SHEET MATERIAL

(75) Inventor: Gerardus Jacobus Marie Kusters, Velden (NL)

(73) Assignee: Syntech Holdings B.V., Venlo (NL)

( * ) Notice: Subject to any disclaimer, the term of this patent is extended or adjusted under 35 U.S.C. 154(b) by 264 days.

(21) Appl. No.: 12/865,624

(22) PCT Filed: Feb. 2, 2009

(86) PCT No.: PCT/NL2009/000021

§ 371 (c)(1),
(2), (4) Date: Oct. 18, 2010

(87) PCT Pub. No.: WO2009/096779

PCT Pub. Date: Aug. 6, 2009

(65) Prior Publication Data

US 2011/0024536 A1 Feb. 3, 2011

(30) Foreign Application Priority Data

Feb. 1, 2008 (NL) ..... 1034988

(51) Int. Cl.
*B02C 21/00* (2006.01)

(52) U.S. Cl. ..... 241/62; 241/242; 241/222; 241/34

(58) Field of Classification Search ..... 241/62, 241/73, 242, 222, 34
See application file for complete search history.

(56) References Cited

U.S. PATENT DOCUMENTS

| | | | | |
|---|---|---|---|---|
| 1,019,828 | A * | 3/1912 | O'Bryan | 241/32 |
| 3,192,853 | A | 7/1965 | O'Connor | |
| 4,028,779 | A * | 6/1977 | Shah | 241/73 |
| 4,664,317 | A | 5/1987 | Morton | |
| 4,903,900 | A * | 2/1990 | Rousseau | 241/30 |
| 7,500,625 | B2 * | 3/2009 | Castronovo | 241/30 |
| 2011/0049277 | A1 * | 3/2011 | Matlin et al. | 241/30 |

FOREIGN PATENT DOCUMENTS

| | | |
|---|---|---|
| EP | 0 622 120 | 11/1994 |

* cited by examiner

*Primary Examiner* — Faye Francis

(74) *Attorney, Agent, or Firm* — Wood, Phillips, Katz, Clark & Mortimer

(57) ABSTRACT

The present invention provides a device for shredding sheet material, comprising shredding means—(2) for shredding the sheet material and a feed conveyor system for feeding sheet material. The feed conveyor system comprises a suction duct (12) having an inlet (19) and an outlet (20), and suction means for sucking sheet material to be shredded from the feed location to the shredding means via the suction duct and for sucking sheet material shredded by the shredding means to the collecting location. The shredding means comprise at least one stationary shear blade (4) and at least one rotary shear blade (3), as well as drive means. The device further comprises detection means for detecting an increased risk of jamming of the shredding means during operation of the device, as well as blocking means (31) which operate in dependence on the detections made by the detection means for partially blocking the suction duct in a blocking position or releasing the suction duct in a free position.

20 Claims, 2 Drawing Sheets

DEVICE FOR SHREDDING SHEET MATERIAL

The present invention relates to a device for shredding sheet material, comprising shredding means for shredding the sheet material and a feed conveyor system for feeding sheet material to be shredded to the shredding means from a feed location and discharging sheet material shredded by the shredding means to a collecting location downstream of the shredding means, said feed conveyor system comprising a suction duct having an inlet and an outlet, which extends between the feed location and the shredding means, suction means for sucking sheet material to be shredded from the feed location to the shredding means via the suction duct and for sucking sheet material shredded by the shredding means to the collecting location, said shredding means comprising at least one stationary shear blade and at least one rotary shear blade, which can rotate along said at least one stationary shear blade, as well as drive means for rotationally driving said at least one rotary shear blade. More specifically, the invention relates to devices by means of which sheet material can be destroyed in a highly controlled manner, to which end sheet material can be fed in individually or in stacks via the inlet.

Such a shredding device is marketed by Kusters Engineering under the type designation RDS 100, said device is in particular intended for destroying bundled valuable papers. A significant risk involved in the operation of such a device is that the device will exhibit malfunctions, inter alia by jamming, for example because shear blades become dull or because (too) much sheet material to be shredded is fed to the shredding means in too short a period of time. As a result of said jamming, the shredding device cannot be used temporarily and must be partially disassembled in order to eliminate the cause of said jamming. In the worst case, this may even lead to damage to the device.

The object of the present invention is to provide a device as referred to in the introduction, in which the risk of malfunctions is reduced as much as possible. In order to accomplish that object, the device according to the invention is in the first place characterised in that the device further comprises detection means for detecting an increased risk of jamming of the shredding means during operation of the device, as well as blocking means which operate in dependence on the detections made by the detection means for partially blocking the suction duct in a blocking position or releasing the suction duct in a free position. The detection means make it possible to determine when there is an increased risk of jamming of the shredding means. As soon as this is the case, the blocking means are activated for partially blocking the suction duct. Thus it is (temporarily) rendered impossible to feed more sheet material to be shredded to the shredding means. During this period, the sheet material that led to the increased risk is processed/shredded by the shredding means. As soon as the risk of jamming of the shredding means as detected by the detection means falls below a predetermined threshold value again, the blocking means can be deactivated, so that the suction duct is opened again and new sheet material to be shredded can be fed to the shredding means. In the blocking position, the blocking means shut off the suction channel only partially. Thus, the sheet material to be destroyed is on the one hand blocked by the blocking means in the blocking position, but on the other hand an air outflow is maintained past the shredding means between the inlet and the suction means.

As an aside, it is noted that in US patent U.S. Pat. No. 3,192,853 a mobile shredding device is described with reference to FIGS. 9 and 10, which shredding device comprises two milling mechanisms 200 and 202 disposed one above the other. A hopper 220 is disposed above the upper milling mechanism 200, on the upper side of which hopper a sealable bin containing confidential papers to be destroyed can be placed in an upside down position. By means of a fan 217, material is sucked through the milling mechanisms 200 and 202 inasfar as the force of gravity apparently would not suffice for this purpose. Doors 224 and 226 are provided at the upper side of the hopper 220, which doors can shut off the feed line at the upper side and which can prevent the covers of the bins 100, which are positioned upside down, from opening. It is described in said publication that when the rotational speed of the grinding mechanisms falls below a predetermined threshold value, hand mechanisms 230' and/or 232' can be operated for closing the doors 224 and 226, and thus the cover of the bin 100. There can be no question of a controlled infeed of papers to be destroyed, however. Processing rather takes place in a bulk-like manner. As soon as the doors 224 and 226 are opened, the entire contents or at least substantially the entire contents of the bin will fall into the hopper 220.

For reasons of constructional simplicity it is preferable if the blocking means comprise a blocking element that can be moved into and completely out of the suction duct, whilst furthermore preferably the blocking element is capable of translating movement into and out of the suction duct and/or the blocking element is pin-shaped. According to another preferred embodiment, the blocking element comprises openings which are smaller than the sheet material to be destroyed, through which openings an air flow can be maintained.

In order to ensure that the movement through the suction duct of the sheet material to be shredded is practically entirely determined by the operation of the suction means whilst the influence of the force of gravity is minimised, it is preferable if the suction duct extends at least substantially in horizontal direction at the location of the blocking means and/or at the location of the inlet.

The blocking means are quite preferably provided near the inlet of the suction duct. In this way sheet material can be prevented from being fed to the suction duct while the blocking means are operative, in which suction duct the sheet material might otherwise form into a ball when blocked by the blocking means, which might lead to the suction duct becoming obstructed.

To utilise the suction capacity as optimally as possible, the suction duct advantageously has a rectangular cross-section, which shape corresponds to the cross-sectional shape of the sheet material to be shredded, which is fed individually or in batches to the shredding means via the suction duct.

The length of the rectangular cross-section at the location of the inlet is preferably maximally 40 cm, more preferably maximally 30 cm, whilst the width of the rectangular cross-section at the location of the inlet is preferably maximally 25 mm, more preferably maximally 20 mm. Thus, paper having a regular size (for example DIN-A4 format) can be fed with its longitudinal direction extending transversely to or parallel to the longitudinal direction of the suction duct with relatively little play. The inlet is more or less letterbox-like in that case, especially if, according to a preferred embodiment discussed in the foregoing, the suction duct extends horizontally.

Another way of reducing the risk of obstructions inside the suction channel is to make the cross-section of the suction duct smaller at the inlet than the cross-section of the suction duct at the outlet, whilst furthermore preferably the cross-section of the suction duct increases continuously in the direction from the inlet to the outlet and/or two opposite walls of the feed duct converge conically, defining a conical angle of maximally 2.5°. It is advisable not to make said conical angle too large, so that the air flow inside the suction duct will remain more or less constant.

According to an important preferred embodiment, the detection means are arranged for measuring the energetic load on the drive means. As soon as the drive means are overloaded, or at least loaded in excess of a predetermined threshold value, this is a clear indication of an increased risk of the shredding means jamming.

Alternatively, or in combination with the preceding preferred embodiment, the detection means are preferably arranged for measuring the pressure upstream and/or downstream of the shredding means. A pressure deviating from the normal pressure (being the pressure during normal operation) upstream and/or downstream of the shredding means, or a pressure difference across the shredding means deviating from a normal pressure difference may be an indication of an increased risk of jamming of the shredding means.

To prevent any further malfunction of the device, it is furthermore preferable if the suction duct has a wall that is at least partially profiled on the inside of the suction duct. It has been found that by using said profile, the risk of sheet material to be shredded sticking to the inner side of the wall of the suction duct, as it were, is significantly reduced. Said "sticking" is caused by an underpressure that may develop between the sheet material to be shredded and the wall of the suction duct.

The same advantage applies if the suction duct comprises a wall in which openings are provided. Via said openings, false air could be sucked in, thus preventing an underpressure being generated between sheet material to be shredded and the wall of the suction duct.

Another important cause of possible malfunction in shredding devices as referred to in the introduction can be eliminated if a screening element is provided along the path of said at least one rotary shear blade, downstream of said at least one stationary shear blade. When such a screening element is used, sheet material to be shredded which has passed said at least one stationary shear blade without being (sufficiently) shredded and which for that reason must be further exposed to the operation of the shredding means before it can be discharged from the shredding means to the collecting location, can be prevented from being flung back to the outlet of the suction duct. At said outlet, such material being flung back might cause the suction duct to become obstructed.

The screening element is preferably positioned near the top of the path of said at least one rotary shear blade. An upper quadrant on one side of the screening element may in that case serve to feed sheet material to be shredded at that location to said at least one rotary shear blade, whilst the screening element screens the outlet of the suction duct from the sheet material to be destroyed that passes said at least one stationary shear blade without being (sufficiently) shredded, and without being discharged to the collecting location, in the other upper quadrant when flung away in the direction of the outlet.

To prevent the screening element itself from being a possible cause of jamming of the shredding means, the screening element is preferably pivoted about a horizontal pivot pin. The screening element can pivot aside as soon as sheet material should accumulate against the screening element, thus making room for the sheet material to pass the screening element.

Another increased risk of jamming/malfunction of the device presents itself when a large amount of sheet material to be shredded is fed to the device at once via the inlet. To minimise this risk, it is preferable if the suction duct comprises adjusting means for adjusting the dimension of the inlet. The object of using such adjusting means is to prevent the need for the blocking means to become operative. If it is found, for example, that the blocking means are activated quite frequently, evidently because the energetic load on the drive means is too high just as frequently, the risk of this situation occurring can be reduced by reducing the dimension of the inlet via the adjusting means.

The invention will be explained in more detail hereinafter by means of a description of a preferred embodiment of the present invention, in which reference is made to the following figures.

Figure 1:
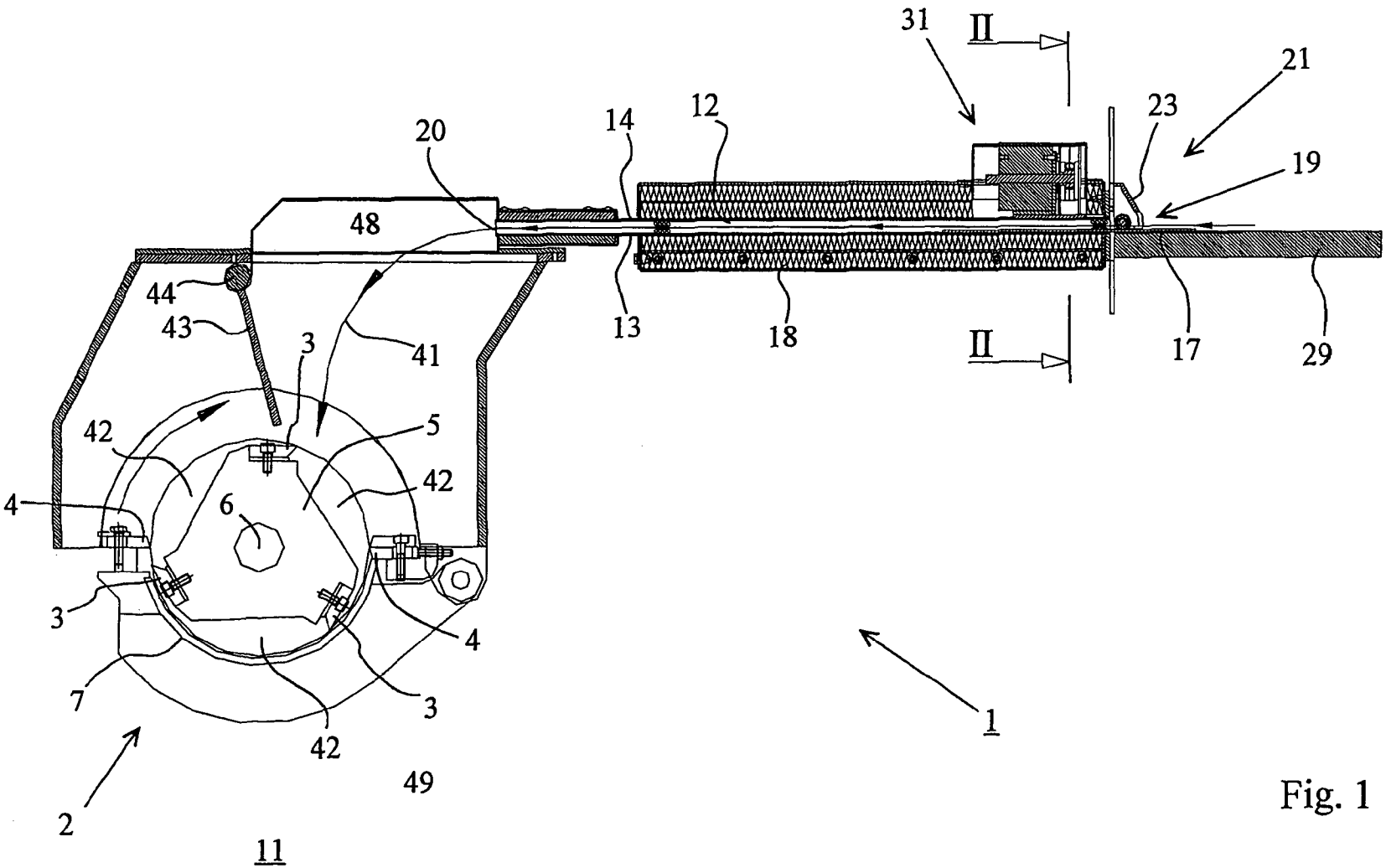
FIG. 1 is a vertical longitudinal sectional view of part of a preferred embodiment of a device according to the invention.
Figure 3A:
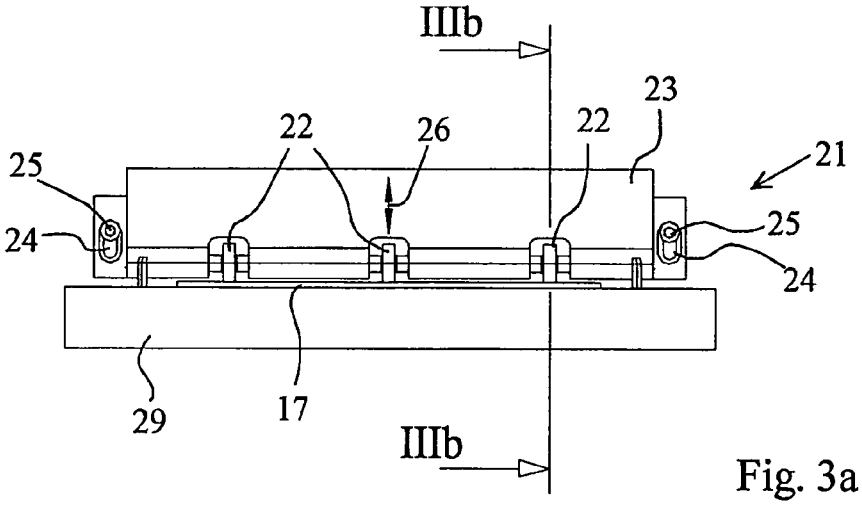
Figure 3B:
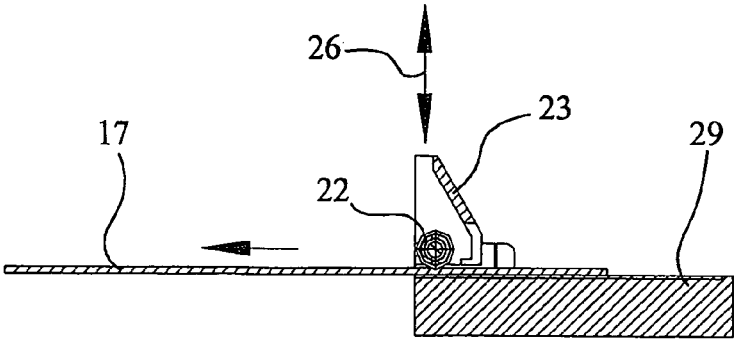

FIG. 3*a* is a front view of the inlet of the suction duct of the device of FIG. 1;

FIG. 3*b* is a longitudinal sectional view along the line IIIb-IIIb in FIG. 3*a*.

The figures show those parts of a shredding device 1 according to the invention that are relevant for a correct understanding of the present invention. The shredding device 1 comprises shredding means 2, which comprise three rotary shear blades 3 and two stationary shear blades 4. The rotary shear blades 3 are each bolted in place near the corner points of a substantially triangular rotary member 5, which can be rotated about an axis of rotation 6 by drive means (not shown). During said rotation, the rotary shear blades 3 move very closely along the stationary shear blades 4, so that scissor-like cutting cooperation is effected when a rotary shear blade 3 passes a stationary shear blade 4. Sheet material caught between a rotary shear blade 3 and a stationary shear blade 4 is thus shredded. Provided along the larger part of the lower half of the circular path of the rotary shear blades 3 is a curved screen 7 provided with screen openings.

A feed conveyor system is provided for supplying sheet material to be shredded, in particular documents. Said feed conveyor system comprises a vacuum source (not shown), which is schematically indicated at 11 in FIG. 1 and which is provided on the sides of the screen 7 remote from the rotary shear blades, or, in other words, downstream of the shredding means 2. The feed conveyor system further comprises a suction duct 12, which extends between an inlet 19 and an outlet 20.

Figure 2:
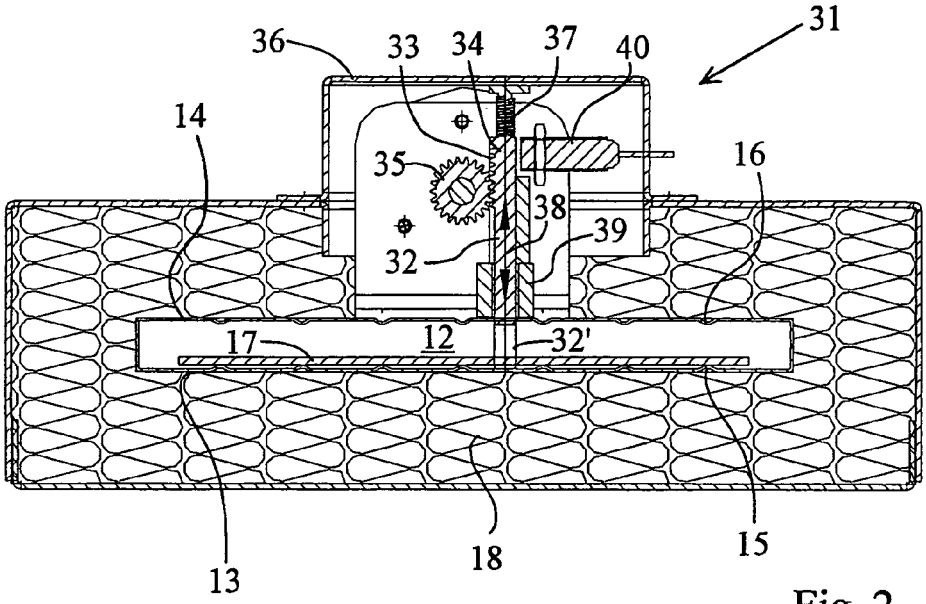
FIG. 2 is a cross-sectional view along the line II-II in FIG. 1.

The suction channel 12 has a rectangular, horizontal cross-section (refer also to FIG. 2). The length of the rectangular cross-section is 250 mm. The longitudinal horizontal walls 13, 14 of the cross-section are provided with inwardly extending profiles 15, 16. Said profiles 15, 16 prevent an item of sheet material 17 to be shredded from abutting flat against one of the horizontal walls 13, 14 of the suction duct 12 over its entire area, with the attendant risk of the sheet material 17 being sucked against the horizontal walls 13, 14 in question on account of an underpressure that might develop between the sheet material 17 and the horizontal walls 13, 14 in question.

Possibly in combination with the profiles 15, 16, it is also possible to form openings in the walls of the suction duct 12, via which openings false air can be drawn in so as to prevent the risk of obstruction inside the suction duct 12 also in this way.

Although this is not shown in FIG. 1, the horizontal walls 13, 14 diverge from the inlet 19 in the direction of the outlet 20, with the directions of the horizontal walls 13, 14 defining a conical angle of 0.5°. As a result of the continuously increasing cross-sectional dimension of the suction duct 12 that is thus realised, the risk of sheet material to be destroyed obstructing the suction duct 12 is further reduced.

The suction duct 12 is surrounded by sound-proofing material along a large part of its length. The sound-damping properties can be further improved by providing the walls of the suction duct 12, among which the walls 13, 14, with perforations. Such perforations in addition reduce the risk of sheet material being sucked against the horizontal walls 13, 14 as described above.

Sheet material 17 to be destroyed is manually fed into the suction duct 12 from a table 29, which may be regarded as a feed location. The inlet 19 (see also FIGS. 3*a* and 3*b*, forms part of an adjusting device 21. Said adjusting device 21 comprises three guide wheels 22, which are rotatably mounted about a horizontal axis in an adjusting frame 23. The guide wheels 22 are disposed above the table 29. The height of the inlet 19 is determined by the distance between the upper side of the table 29 and the bottom side of the guide wheels 22. In use, a typical height of the inlet is maximally 15 mm. The aforesaid distance determines the height (thickness) of the sheet material 17 that can be fed to the suction duct in one go. Although it has been assumed so far that the sheet material consists of single sheets, said sheet material may also consist of a bundle of sheet material. The adjusting frame 23 is provided with a slotted holes 24 on the sides, through which bolts 25 extend. The slotted holes 24 make it possible to vertically adjust the adjusting frame 23, and thus the guide wheels 22, as indicated by the double arrow 26. The adjusted position can be fixed by tightening the bolts 25 when a desired height of the inlet 19 is reached.

Shortly behind the inlet 19, a blocking device 31 is provided above the suction duct 12. Said blocking device 31 comprises a vertical pin 32, which is provided with teeth 33 at the upper end thereof, so that the pin 32 will function as a gear rack 34 at that location. The blocking device 31 further comprises a gear 35 that is rotatable about a horizontal axis, whose teeth engage the teeth 33 of the gear rack 34. A compression spring 37 is provided between the pin 32 and the upper wall of the housing 36 of the blocking device 31. The pin 32 can move up and down as indicated by the double arrow 38. At its lower end, the pin 32 is accommodated in a guide bush 39 for guiding said movement. The blocking device 31 further comprises a sensor 40, by means of which the position of the pin 32 can be determined.

In the inactive position shown in FIG. 2, the lower end of the pin 32 just extends through an opening in the upper horizontal wall 14 of the suction duct 12. In the active position, the pin 32 will abut against the upper side of the lower horizontal wall of the suction duct 12 with its lower end. This situation is indicated at 32'. In this active position, sheet material 17 cannot pass the pin 32, so that no sheet material 17 can be fed from the table 29.

The shredding device 1 function is as follows: the starting situation is the situation in which the vacuum source 11 is operative, the pin 32 of the blocking means 31 is in the inactive (i.e. upper) position, and the rotary member 5 of the shredding means 2 rotates about the axis of rotation 6, being driven by the drive means. Sheet material 17 is manually fed to the suction duct 12 from the table 29 via the inlet 19. Once the sheet material 17 extends sufficiently far into the suction duct 12, the sheet material 17 is sucked through the suction duct 12 by the vacuum source 11 and exits the suction duct 12 at the outlet 20.

Under the influence of the force of gravity and also as a result of the operation of the vacuum source 11, the sheet material 17 bears off in downward direction as indicated by the arrow 41 and falls onto the upper quadrant of the rotary shear blades 3 (located on the right-hand side in FIG. 1). At that location, the sheet material is caught between the rotary shear blades 3 and the stationary shear blades 4, as a result of which the sheet material 17 is cut up into smaller parts. Between the rotary member 5 and the screen 7, the slightly shredded sheet material 17 collects in one of the three segment-shaped spaces 42 defined by the circular path of the rotary shear blades 3 and the flat sides of the triangular shape of the rotary member 5. Said shredding of the sheet material 17 is continued until the dimensions of the shredded material are smaller than the openings in the screen 7, after which the sheet material 17 will pass through said openings in the screen 7 under the influence of the suction force of the vacuum source 11. The shredded sheet material is subsequently collected at a collecting location for further processing.

While the rotary member 5 and thus the sheet material rotates about the axis of rotation 6, there is a risk that sheet material will be flung back from the upper left-hand quadrant in FIG. 1 towards the outlet 20 of the suction duct 12, wherein it might cause the suction duct 12 to become obstructed. To prevent this, an at least substantially vertically extending plate 43 is provided, which prevents sheet material 17 being flung back towards outlet 20. The substantially vertically oriented plate 43 points to the top the circular path of the rotary shear blades 3, as it were. Because of this selected configuration, the plate 43 does not impede the feeding of sheet material 17 from the outlet 20 to the shredding means 2. The plate 43 is freely suspended from a horizontal pivot pin 44. This makes it possible for the plate 43 to pivot about the pivot pin 44 as soon as sheet material should accumulate against the plate 43 so as to make room for the sheet material to pass the plate 43.

The shredding device 1 comprises detection means (not shown) by means of which it can be determined whether the driving motor for rotating the rotary member 5 is being loaded in excess of a predetermined threshold value. Said detection means may for example measure the rotational speed of the rotary member 5 or the current power consumption of the driving motor. A decrease of the rotational speed or an increase of the power consumption of the driving motor forms an indication that the device is about to jam. To minimise this risk, the detection means deliver a control signal to the blocking device 31 as soon as the threshold value is exceeded, on the basis of which control signal the blocking device 31 becomes operative and the pin 32 is moved to the lower, active position. Paper to be destroyed, which is being fed in by an operator, may be clamped between the pin and the lower horizontal wall 13 in that case. Thus it is no longer possible to feed extra material to the shredding means 2. Once it is established via the detection means that the drive means are no longer being subjected to an increased load, a control signal will be delivered to the blocking device 31, so that the pin 32 will return to the higher, inactive position and new sheet material 17 can be fed in from the table 29.

Alternatively, or in combination with the detection means as described above, it is also possible to use detection means which measure the pressure upstream and/or downstream of the shredding means 2 by means of pressure sensors, which may for example be provided at the locations indicated at 48 and 49. A pressure value different from the pressure in a normal situation forms an indication that there is an increased risk of jamming of the shredding means 2. A pressure decrease at the sensor 49 (i.e. a higher underpressure), for example, may be caused by the fact that insufficient air can be sucked in past the shredding means, the reason for which may be that too much sheet material is present at the shredding means 2. In response thereto, the blocking device 31 may be activated via the control means, so that the further supply of sheet material to be destroyed to the shredding means 2 is blocked.

The invention claimed is:

1. A device for shredding sheet material, comprising shredding means for shredding the sheet material and a feed conveyor system for feeding sheet material to be shredded to the shredding means from a feed location and discharging sheet material shredded by the shredding means to a collecting location downstream of the shredding means, said feed conveyor system comprising a suction duct having an inlet and an outlet, which extends between the feed location and the shredding means, suction means for sucking sheet material to be shredded from the feed location to the shredding means via the suction duct and for sucking sheet material shredded by the shredding means to the collecting location, said shredding means comprising at least one stationary shear blade and at least one rotary shear blade, which can rotate along said at least one stationary shear blade, as well as drive means for rotationally driving said at least one rotary shear blade, characterised in that the device further comprises detection means for detecting an increased risk of jamming of the shredding means during operation of the device, as well as blocking means which operate in dependence on the detections made by the detection means for partially blocking the suction duct in a blocking position or releasing the suction duct in a free position.

2. A device according to claim 1, characterised in that the blocking means comprise a blocking element that can be moved into and completely out of the suction duct.

3. A device according to claim 2, characterised in that the blocking element is capable of translating movement into and out of the suction duct.

4. A device according to claim 2, characterised in that the blocking element is pin-shaped.

5. A device according to claim 1, characterised in that the suction duct extends at least substantially in horizontal direction at the location of at least one of the blocking means and the inlet.

6. A device according to claim 1, characterised in that the blocking means are provided near the inlet of the suction duct.

7. A device according to claim 1, characterised in that the suction duct has a rectangular cross-section.

8. A device according to claim 7, characterised in that the length of the rectangular cross-section at the location of the inlet is maximally 40 cm.

9. A device according to claim 7 characterised in that the width of the rectangular cross-section at the location of the inlet is maximally 25 mm.

10. A device according to claim 1, characterised in that the cross-section of the suction duct is smaller at the inlet than the cross-section of the suction duct at the outlet.

11. A device according to claim 1, characterised in that the cross-section of the suction duct increases continuously in the direction from the inlet to the outlet.

12. A device according to claim 8, characterised in that two opposite walls of the feed duct converge conically, defining a conical angle of maximally 2.5° .

13. A device according to claim 1, characterised in that the detection means are arranged for measuring the energetic load on the drive means.

14. A device according to claim 1, characterised in that the detection means are arranged for measuring the pressure upstream and/or downstream of the shredding means.

15. A device according to claim 1, characterised in that the suction duct has a wall that is at least partially profiled on the inside of the suction duct.

16. A device according to claim 1, characterised in that the suction duct comprises a wall in which openings are provided.

17. A device according to claim 1, characterised in that a screening element is provided along the path of said at least one rotary shear blade, downstream of said at least one stationary shear blade.

18. A device according to claim 17, characterised in that the screening element is positioned near the top of the path of said at least one rotary shear blade.

19. A device according to claim 17, characterised in that the screening element the screening element is pivoted about a horizontal pivot pin.

20. A device according to claim 1, characterised in that the suction duct comprises adjusting means for adjusting the dimension of the inlet.

* * * * *